United States Patent [19]

Wührer

[11] Patent Number: 4,540,341

[45] Date of Patent: Sep. 10, 1985

[54] ADJUSTABLE PROPELLER FOR MARINE VESSEL DRIVE

[75] Inventor: Wolfgang Wührer, Ravensburg, Fed. Rep. of Germany

[73] Assignee: Escher Wyss GmbH, Ravensburg, Fed. Rep. of Germany

[21] Appl. No.: 566,304

[22] Filed: Dec. 28, 1983

[30] Foreign Application Priority Data

Jan. 17, 1983 [CH] Switzerland ..... 228/83

[51] Int. Cl.[3] ..... B63H 3/08; B64C 11/40

[52] U.S. Cl. ..... 416/157 R; 416/98; 416/158

[58] Field of Search ..... 416/98, 167, 114, 158, 416/157 R

[56] References Cited

U.S. PATENT DOCUMENTS

| | | | |
|---|---|---|---|
| 2,703,147 | 3/1955 | Peterson | 416/98 |
| 2,919,753 | 1/1960 | Hook | 416/158 R X |
| 2,984,306 | 5/1961 | Kottsieper | 416/98 |
| 3,101,066 | 8/1963 | Haselton | 416/98 X |
| 3,323,598 | 6/1967 | Lindahl | 416/114 X |
| 3,536,415 | 10/1970 | Kusiak | 416/157 X |
| 4,132,503 | 1/1979 | Kreft et al. | 416/167 |
| 4,379,678 | 3/1983 | Carlock et al. | 416/98 |

FOREIGN PATENT DOCUMENTS

| | | | |
|---|---|---|---|
| 2757617 | 6/1979 | Fed. Rep. of Germany | 416/155 |
| 508212 | 1/1955 | Italy | 416/167 |
| 201106 | 1/1966 | Sweden | 416/114 |
| 560626 | 4/1975 | Switzerland | 416/157 R |
| 325538 | 2/1930 | United Kingdom . | |
| 637238 | 5/1950 | United Kingdom | 416/168 R |
| 126385 | 4/1960 | U.S.S.R. . | |

OTHER PUBLICATIONS

"The Pinnate Propeller", (Ship and Boat International), Jan./Feb. 1978, p. 61.

*Primary Examiner*—Everette A. Powell, Jr.
*Attorney, Agent, or Firm*—Werner W. Kleeman

[57] ABSTRACT

The adjustable propeller has an adjusting mechanism for adjusting the pitch of the individual propeller blades. The adjusting mechanism comprises an actuator and a correction mechanism for each propeller blade for cyclically adjusting the pitch angle of a related propeller blade under the control of a control device.

11 Claims, 9 Drawing Figures

ADJUSTABLE PROPELLER FOR MARINE VESSEL DRIVE

BACKGROUND OF THE INVENTION

The present invention broadly relates to propeller devices and, more specifically, pertains to a new and improved construction of an adjustable propeller or adjustable pitch propeller for marine vessels.

In its more specific aspects the present invention relates to an adjustable pitch propeller for marine vessels having an adjusting or adjustment mechanism for adjusting the pitch angle or pitch of the propeller blades or vanes.

Adjustable propellers of this type are common and serve to adjust the pitch angle of the propeller blades or vanes to different operating conditions of the vessel, such as reversal of direction.

In known propellers the adjusting mechanism acts on the propeller blades in such a manner that the pitch angles of all propeller blades are always equal.

On the other hand it is well known that propellers mounted in the stern of a vessel are subjected to non-uniform or irregular flow conditions, so that each propeller blade encounters differing flow conditions in different angular positions during one revolution. This reduces its efficiency and induces cavitation.

In order to eliminate this disadvantage, it has already been proposed to cyclically vary the pitch angle or pitch of the blades of ship propellers during each revolution, for instance by means of a cam device. This cyclical variation of the pitch angle of each blade is effected during each revolution in relation to the flow conditions that it encounters. In this respect, attention is directed, for instance, to British Pat. No. 325,538, USSR Pat. No. 126,385 or the article "The Pinnate Propeller" in the magazine "Ship and Boat International" of January/February 1978, page 61.

Although in all of these propellers the propeller blades are rotatively adjusted, they are not truly adjustable pitch propellers in the sense described. In truly adjustable pitch propellers a conjoint simultaneous adjustment of all propeller blades to the operating conditions would be possible. In known propellers a continuous modification of the pitch angle of the propeller blades during one revolution is not possible. This would, for instance, be useful for different speeds and different depths of displacement of the hull of the ship. For these reasons such propellers have not been successful in practice.

SUMMARY OF THE INVENTION

Therefore, with the foregoing in mind it is a primary object of the present invention to provide a new and improved construction of an adjustable pitch propeller which does not have associated with it the aforementioned drawbacks and shortcomings of the prior art constructions.

Another and more specific object of the present invention aims at providing a new and improved construction of an adjustable pitch propeller of the previously mentioned type which permits, on the one hand, an adjustment of the pitch angle or pitch of the propeller blades to operating conditions as well as a reversal of pitch and a supplementary cyclical correction of this pitch angle during each revolution of the propeller, on the other hand, allowing the varying flow conditions to be taken into consideration in such a way that the corrections can be matched to changes in flow conditions arising, for instance, in conjunction with various depths of displacement or at various speeds of the vessel.

In keeping with the immediately preceding object of the invention it is a further object thereof to provide an adjustment and correction means for this purpose at a minimum of additional complication in comparison to known adjustable pitch propellers.

It is a further object of the invention to assure continued normal operation of the adjustable pitch propeller in the case of a malfunction of the correcting or correction mechanism.

Yet a further significant object of the present invention aims at providing a new and improved construction of an adjustable pitch propeller of the character described which is relatively simple in construction and design, extremely economical to manufacture, highly reliable in operation, not readily subject to breakdown or malfunction and requires a minimum of maintenance and servicing.

Now in order to implement these and still further objects of the invention, which will become more readily apparent as the description proceeds, the adjustable pitch propeller of the present invention is manifested by the features that for each propeller blade there is provided a correction mechanism contained in the adjusting mechanism and driven by an actuating device or actuator, in order to individually adjust the pitch angle of the related propeller blade, and that the action of the correction mechanism is superimposed upon the action of the adjusting mechanism. The operation of the actuator or drive of the correction mechanism is governed by a control device to cyclically modify the adjustment of the associated propeller blade during each rotation or revolution of the propeller.

In the adjustable pitch propeller according to the invention the rotatable mounting of the propeller blades or vanes and the adjusting mechanism are modified or augmented in a simple manner such that the correction possibilities mentioned above are obtained. This permits an improvement in the efficiency of the propeller which is particularly important in view of the modern tendency to large propellers with low speeds of rotation. If the correction mechanism fails, the adjusting mechanism of the propeller blades remains in normal operation so that further travel or motion of the vessel is possible at all times.

In a preferred embodiment of the invention the adjusting mechanism can impart its effects to the propeller blades through a journal whose position can be adjusted by means of a rotatable component having an axis of rotation eccentric to the axis of the journal and driven by the related actuating device or actuator, for instance constituted by a so-called correction motor.

When suitably constructed, this embodiment permits an operation of the adjusting or adjustment mechanism by means of relatively low forces. When suitably designed, there is also a certain self-retarding effect which prevents or at least diminishes the transmission of forces from the propeller blades to the correction actuators.

In a propeller of this type the journal can be mounted in the eccentric bore of a bushing rotatably driven by the related correction actuator. Alternatively, the journal can be eccentrically mounted on a shaft rotatably driven by the related correction actuator.

In both of the latter cases the correction actuator or correction motor can be a cylinder-and-piston unit or mechanism. The rotatable component having an eccentric relation to the journal is provided with a crank arm or lever which is driven by the cylinder-and-piston mechanism.

The correction actuator can also be a rotary vane or piston actuator or motor. In both cases, particularly simple designs are obtained.

The eccentrically mounted rotating parts and the actuators or correction motors are preferably mounted on an adjustment part or crosshead of an adjustment motor or actuator movably disposed within the hub of the propeller and extending in the direction of its axis of rotation. The adjustment part or crosshead can be part of a conventional hydraulic cylinder-and-piston unit or mechanism. This arrangement is advantageous since, for instance, the hydraulic fluid for the correction actuators or motors can be supplied through the hollow propeller shaft in the same manner as for the adjustment actuator or motor.

The adjusting mechanism can comprise connecting rods or brackets or the like connected to the individual propeller blades. The connecting rods are provided with bores cooperating with the journals of the adjustment part or crosshead and of the propeller blades. The journals in the adjustment crosshead can be mounted eccentrically and their position can be adjusted by the related correction actuator or motor. This construction of propeller permits a robust mounting of the propeller blades.

In a propeller constructed in this manner the connecting rods or brackets also can be formed in two parts, one rod component forming the cylinder and the other rod component the piston and piston rod of the related cylinder-and-piston mechanism. This arrangement permits a very simple design of the correction mechanism.

In adjustable pitch propellers whose blades are mounted in so-called disc bearings, the adjusting mechanism can have journals engaging by means of slide blocks with parallel slideways or guide grooves. The journals can be eccentrically mounted and adjustable by the related correction actuator or motor. In this manner, the invention can be also applied to this type of adjustable pitch propeller.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
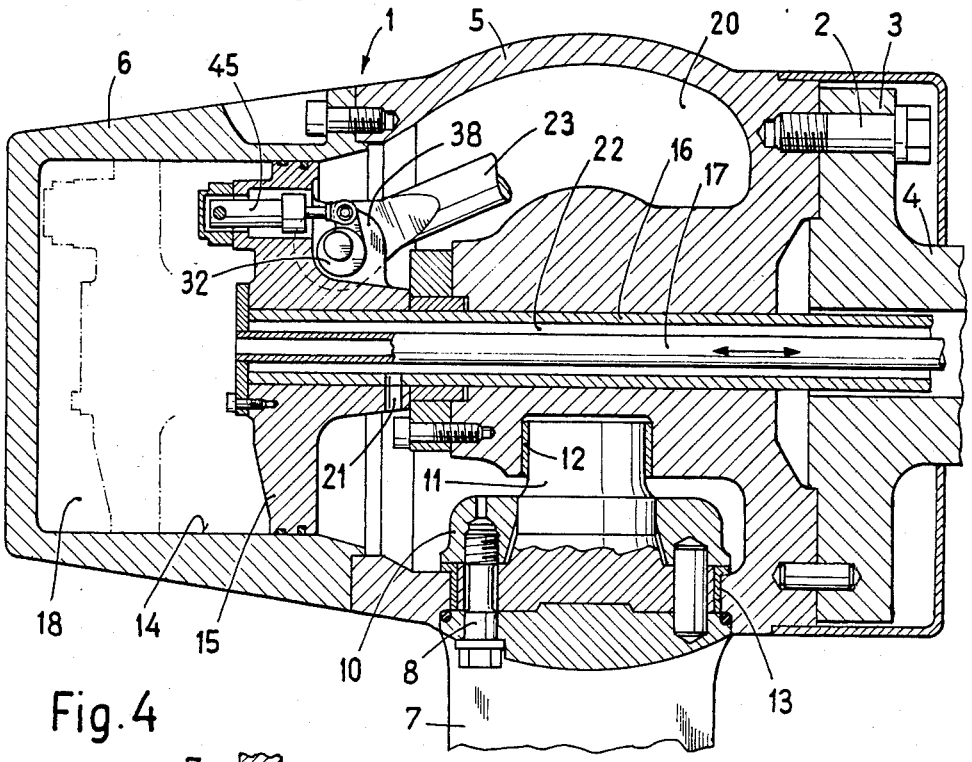
FIG. 1 is a schematic section through an adjustable pitch propeller constructed according to the present invention.

Describing now the drawings, it is to be understood that to simplify the showing of the drawings only enough of the structure of the adjustable pitch propeller has been illustrated therein as is needed to enable one skilled in the art to readily understand the underlying principles and concepts of the present invention. Turning attention now to FIG. 1 the therein illustrated exemplary embodiment of adjustable pitch propeller will be seen to comprise a hub housing 1 fixed to the flange 3 of a hollow propeller shaft 4 by bolts 2 or equivalent structure. Hub housing 1 comprises two parts, a bearing part or component 5 and a cylinder part or component 6. A plurality of, for instance four, propeller blades or vanes 7 are rotatably mounted in the bearing part 5. These blades 7 are fixed to bearing journals 11 by bolts 8 and retaining rings 10. Bearing journals 11 are mounted in inner bearing bushes 12 and outer bearing bushes 13.

A cylinder bore 14 is formed in the cylinder part 6. A piston 15, defining an adjustment part or crosshead of this adjustment actuator or motor 6, 15, is sealingly guided in the cylinder bore 14 in the axial direction or direction of the axis of rotation of the hub housing 1. Piston 15 is connected to any suitable source of hydraulic fluid, not shown in the drawings, by concentric conduits or lines 16 and 17. This source of hydraulic fluid and the associated control devices are known as such and do not form part of the invention. It is sufficient to mention that the hydraulic fluid, typically hydraulic oil, flows through the inner conduit 17 into a cylinder chamber 18 of the cylinder part or component 6 and urges the piston 15 to the right in FIG. 1. Hydraulic oil contained in an inner chamber 20 of the bearing part or component 5 flows through an aperture or bore 21 into an intermediate space 22 between the conduits 16 and 17 which acts as a return conduit. For the reverse operation, the hydraulic oil can be supplied through the intermediate space 22 and the aperture or bore 21 into the inner chamber 20 while the oil in the cylinder chamber 18 returns through the inner conduit 17. In this case the piston 15 moves to the left in FIG. 1.

As can further be seen from FIG. 1, connecting rods or rod-like brackets 23 engage the piston 15 and, at their opposite ends, journals of crank arms not shown in FIG. 1, mounted on retaining rings 10 of propeller blades 7. Since these journals are disposed in eccentric relation to the bearing journals 11, motions imparted by the piston 15 to the connecting rods 23 to the left or the right in FIG. 1, produce a corresponding rotation of the bearing journals 11 and propeller blades or vanes 7. This arrangement is generally known and does not form part of the present invention.

Figure 2:
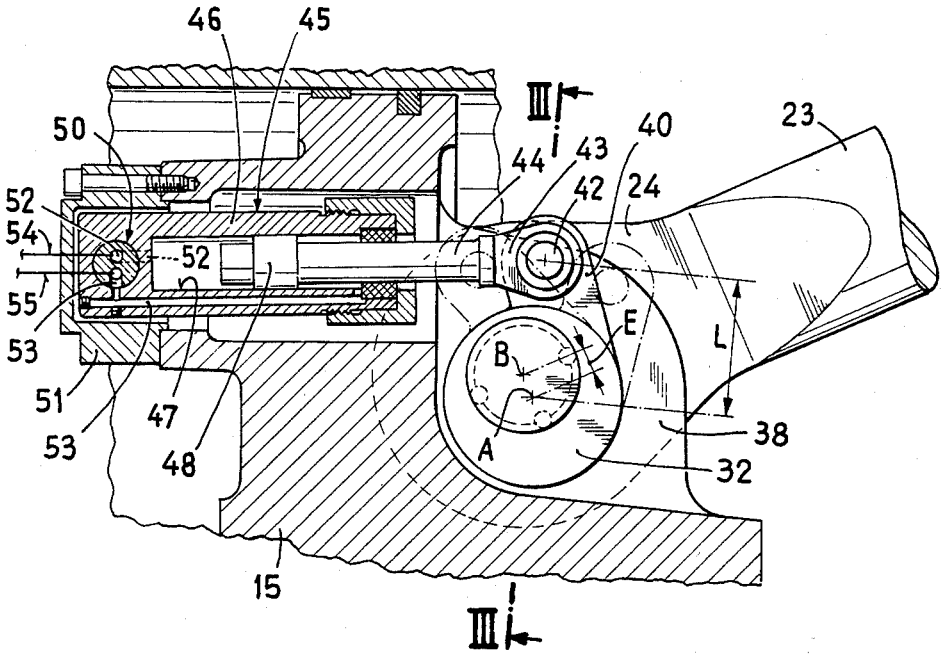
FIG. 2 is a fragmentary view of the section of FIG. 1 on an enlarged scale.
Figure 3:
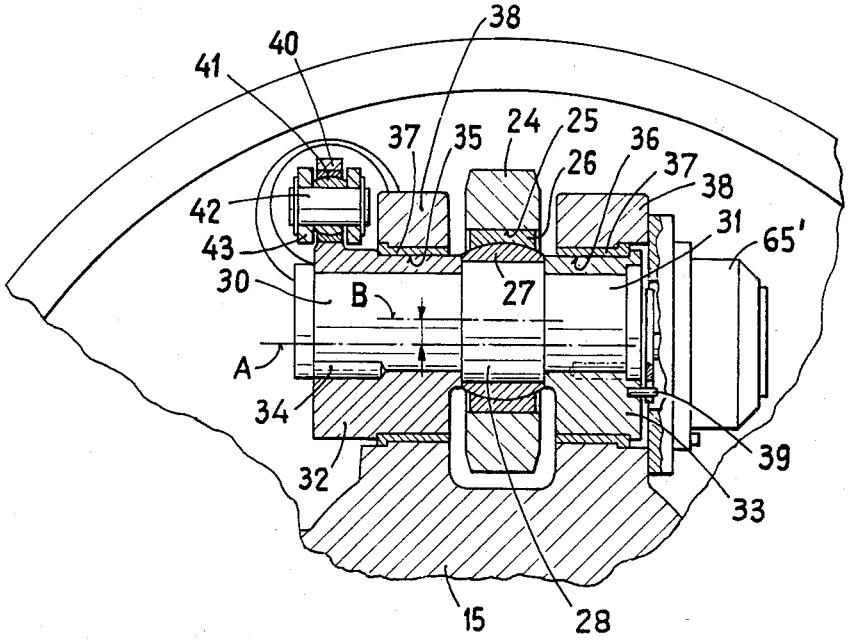
FIG. 3 is a schematic sectional view taken substantially along line III—III of FIG. 2.

As can be seen from FIGS. 2 and 3, the end of the connecting rod 23 engaging the piston or piston member 15 is provided with a bearing boss or head 24 having a bore 25. Bore 25 rotatably engages a journal 28 by means of two bushings 26 and 27 having mutual spherical bearing surfaces. Journal 28 has shaft ends 30, 31 fixed in bushings 32, 33 and locked against rotation by pins 34 or the like. Bushings 32, 33 have outer bearing surfaces 35, 36 rotatably mounted in bushings 37 of twin-forked projections or fins 38 on the piston 15.

As can be seen from FIGS. 2 and 3, the axis of rotation A of the bearing surfaces 35, 36 is displaced in relation to the axis B of the journal 28. The relative eccentricities of axes A and B is designated as E in FIG. 2.

As can be further seen from FIGS. 2 and 3, the bushing 32 is provided with a crank arm or lever 40 having a not particularly referenced bore in which a journal 42 is rotatably mounted by means of two bearing bushes 41 having mutual spherical bearing surfaces. Journal 42 is fixed in the bifurcated or forked end 43 of a piston rod 44 of a cylinder-and-piston mechanism 45. The cylinder-and-piston mechanism 45 comprises a cylinder block or cylinder 46 having a cylinder bore 47 for movably accommodating a piston 48 with its piston rod 44. Cylinder block or cylinder 46 is pivotably mounted on a pivot pin 50. Pivot pin 50 is fixed in a connecting part or mounting cap 51 which is in turn fixed to a projection or boss on the piston 15. The cylinder-and-piston mechanism 45 is disposed within an aperture or bore in the piston 15 and mounting cap 51.

Pivot pin 50 is provided with bores or channels 52 and 53 for the supply and return of hydraulic fluid. Corresponding bores or channels in the cylinder block or cylinder 46 lead to the cylinder chambers of the cylinder bore 47 to the left and right of the piston 48. The bores or channels 52 and 53 of the pivot pin 50 are connected to schematically represented conduits or lines 54 and 55.

Figure 4:
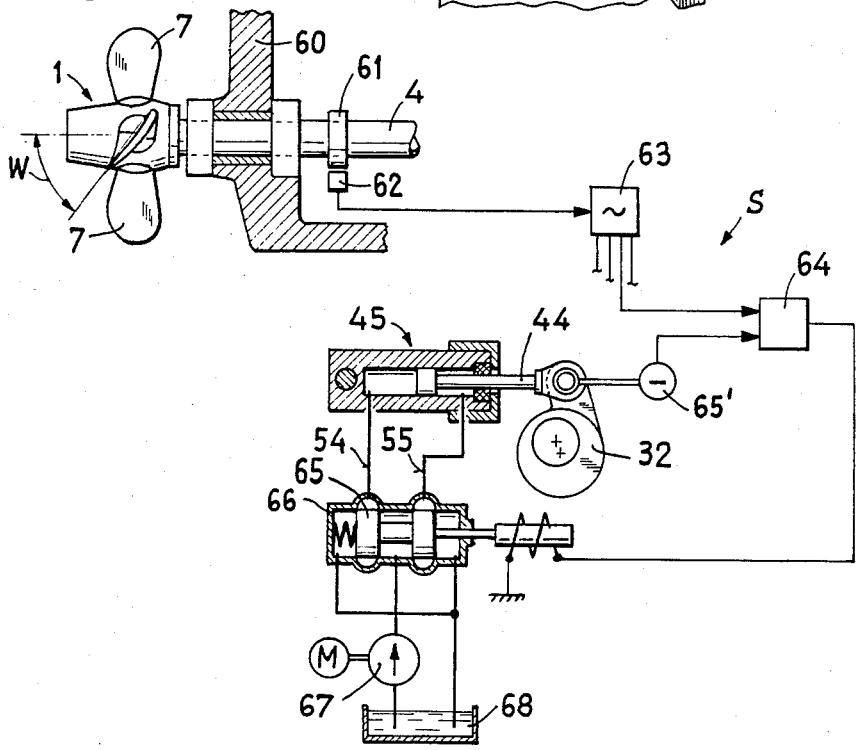
FIG. 4 is a schematic diagram of the controlling system or control means for the correction actuators or motors and the correction mechanism during one revolution of the propeller according to FIGS. 1 through 3.

FIG. 4 schematically illustrates the arrangement of the adjustable pitch propeller with the hub 1, propeller blades 7 and propeller shaft 4 in the stern of a marine vessel together with a control device or control means S for regulating or actuating the correction mechanism. Propeller shaft 4 is provided with an index ring 61 having suitable index marks. By means of a position sensor or feeler 62 the index marks can be appropriately sensed, for instance electromagnetically, in order to determine the current or momentary angular position of the propeller shaft 4 and propeller 1 with propeller blades 7 in relation to the ship's hull 60. Position sensor or feeler 62 transmits its signal to a reference or set signal generator 63. Reference signal generator 63 generates reference or set signals for each individual propeller blade 7 corresponding to its current angular position with respect to the hull 60 of the ship. The reference signals are transmitted to process controllers or regulators 64, one of which is operatively associated with each related propeller blade 7. Process controller or regulator 64 compares the reference or set signal of the reference signal generator 63 with the actual position signal transmitted by the corresponding pitch sensor 65'. Pitch sensor 65' senses the position of the piston rod 44 of the cylinder-and-piston unit or mechanism 45. If there is a deviation of the actual or true pitch angle in relation to the reference or set signal, then the control processor or regulator 64 generates an output signal to activate the valve body 65 of a hydraulic control valve 66. According to its position within the bore of the housing of the control valve 66, the valve body 65 controls the delivery of hydraulic fluid from a hydraulic fluid source 67 through conduits 54 or 55 to the cylinder chambers of the cylinder-and-piston unit or mechanism 45. At the same time, the hydraulic medium in the chamber on the opposite side of the piston can be returned to a reservoir 68 in conventional manner.

The arrangement of the pitch angle sensor 65' in the correction mechanism can be seen in FIG. 3. It is mounted on the projection or fin 38 and connected to the rotary bushing 33 by a pin 39 or the like.

In operation the propeller 1 with its propeller blades 7 is driven by a suitable drive motor, not shown in the drawings, through the propeller shaft 4. By adjusting the position of the piston 15 in the cylinder bore 14, a desired basic pitch angle of the propeller blades 7, designated as W in FIG. 4, can be selected in the manner described above. The current angular position of the propeller blades is detected from the index ring 61 by the position sensor or feeler 62 when the propeller shaft 4 rotates. Reference signal generator 63 and process controller or regulator 64 assure that the cylinder-and-piston mechanism 45, which forms a correction actuator or motor, imparts a cyclical adjustment to the associated propeller blade 7 through eccentric journals 28 during each rotation of the propeller 1. As can be seen from FIG. 2, the ratio of eccentricity E to lever arm L of the journal 42, which is engaged by the cylinder-and-piston mechanism 45, effects a mechanical advantage so that a relatively small force produced by the cylinder-and-piston unit or mechanism 45 is sufficient to effect the correction motion of the corresponding propeller blade 7. The resulting longer travel of the pistons is advantageous for the accuracy of sensing the pitch angle of the propeller blades 7. Due to an at least partial self-locking effect, the eccentric bushes 32, 33 absorb shocks transmitted from the propeller blades 27 through the connecting rods 23 or at least reduce their intensity in transmitting them to the cylinder-and-piston mechanism 45.

In the embodiments according to FIGS. 2 and 3, the journal 28 is rigidly fixed to the bushings or bushes 32, 33 by a pin 34, forming a sort of crankshaft. This fixation is provided to transmit rotary motion from bushing 32 to bushing 33.

Figure 5:
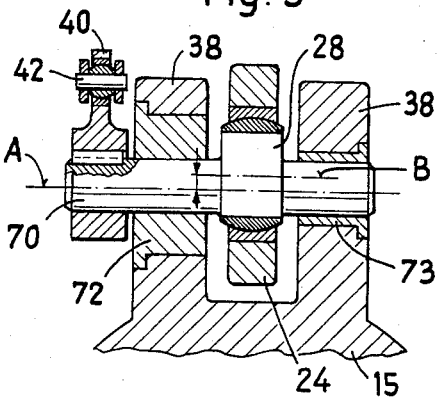
FIG. 5 schematically illustrates a modified embodiment of the correction mechanism according to FIGS. 2 and 3.
Figure 6:
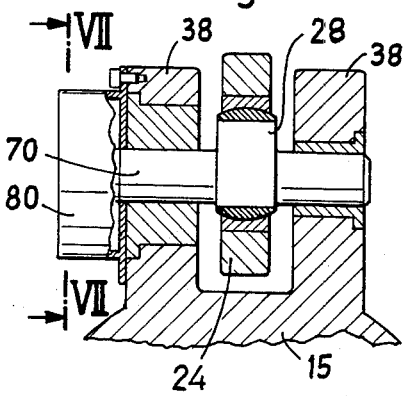
FIG. 6 schematically illustrates an embodiment of the correction mechanism according to FIG. 5 employing a rotary vane actuator or motor as the actuating device or drive motor.

FIGS. 5 and 6 show a further embodiment of the eccentric mounting of the journal 28. In this case, the journal 28 is provided with substantially cylindrical extensions forming a shaft 70. Shaft 70 is rotatably mounted in bushings or bushes 72, 73 of the forked projections or fins 38. Crank arm or projection 40 of FIGS. 2 and 3 takes, in this case, the form of a lever fixed upon the shaft 70.

Figure 7:
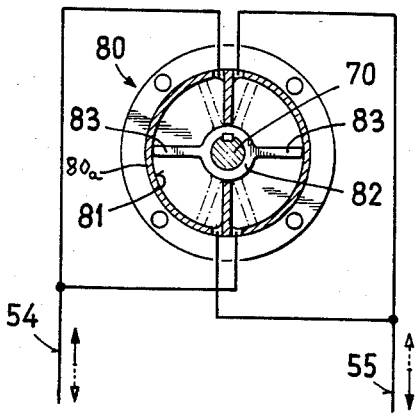
FIG. 7 is a schematic section through the rotary vane actuator taken substantially along line VII—VII in FIG. 6.

The embodiment according to FIG. 6 differs from that according to FIG. 5 only in that the crank arm or lever 40 and the cylinder-and-piston mechanism 45 are replaced by a rotary vane actuator or motor 80 directly mounted on the shaft 70 for imparting adjustment motion to the journal 28. FIG. 7 shows a section through this rotary vane actuator or motor 80. The rotary vane actuator 80 comprises a housing 80*a* containing a rotary piston or vane 82 formed by two radial vanes 83 and mounted on the shaft 70. FIG. 7 also schematically shows the connection of the rotary vane actuator 80 to the control conduits 54 and 55 of FIG. 4.

Figure 8:
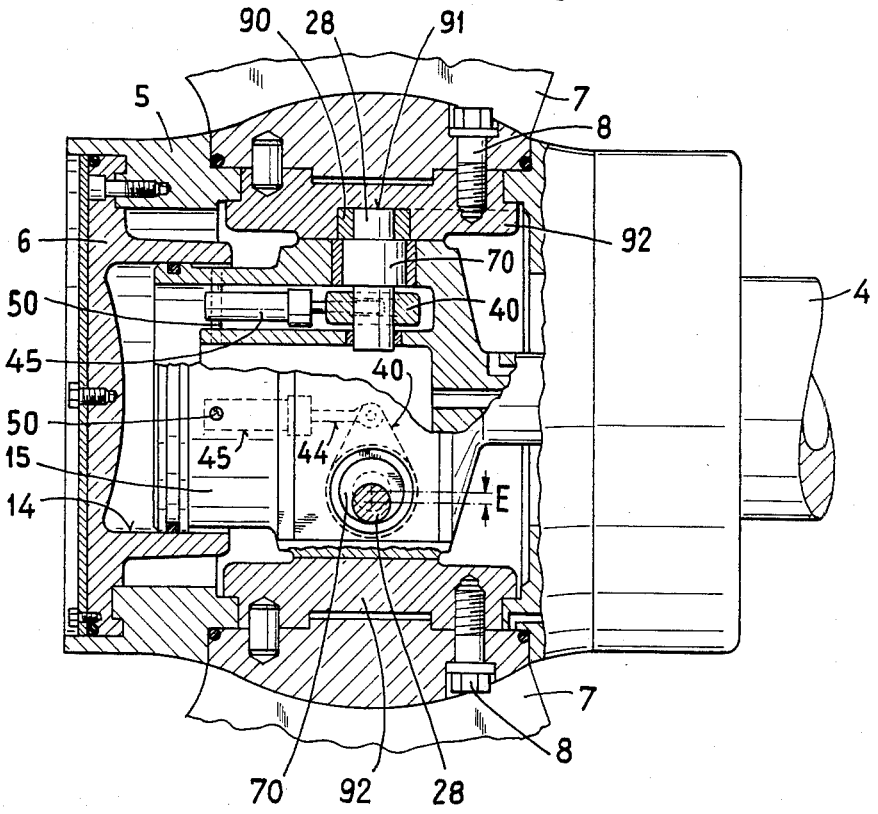
FIG. 8 is a schematic partial section through a propeller according to the invention and having its propeller blades mounted in disc bearings.

FIG. 8 shows the application of the invention to a propeller having its blades mounted in so-called disc bearings. Such a propeller is described in the commonly assigned copending U.S. application Ser. No. 06/467,899, filed Feb. 18, 1983, to which reference may be had and the disclosure of which is incorporated herein by reference. This adjustable pitch propeller also has a bearing part or component 5 in which the propeller blades 7 are rotatably mounted and a cylinder part or component 6 having a cylinder bore 14 which is, in this case, disposed within the bearing part 5. Piston 15 is structured as a pitch angle adjustment part or crosshead in which stub shafts 70 are rotatably mounted. Stub shafts 70 are provided with eccentric journals 28. As can be seen from the upper portion of FIG. 8, the journals 28 are accommodated in rectangular slide or guide blocks 90. Slide or guide blocks 90 are guided in slideways or guide grooves 91 which extend in a direction substantially perpendicular to the axis of rotation of the propeller and of the propeller shaft 4. Slideways or guide grooves 91 are formed in bearing discs 92 in known manner. Propeller blades 7 are rotatably mounted in the bearing part 5 by means of these disc bearings 92.

As in the embodiment according to FIG. 5, a crank arm or lever 40 is fixed to each stub shaft or shaft 70 and engaged by the piston rod 44 of the cylinder-and-piston unit or mechanism 45. The cylinder block or cylinder of the cylinder-and-piston mechanism 45 is, as in the embodiment according to FIG. 2, rotatably supported on a pivot pin 50 through which the connection to the conduits for the hydraulic medium can be made. The control device can also be the same as shown in FIG. 4.

Figure 9:
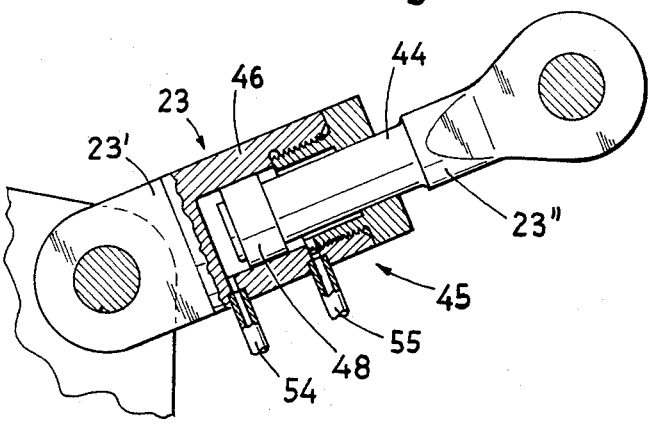
FIG. 9 is a schematic view, partly in section, of a connecting rod or bracket of the propeller according to FIG. 1 having the correction mechanism built into the related connecting rod.

FIG. 9 shows a correction mechanism which is built into a connecting rod or rod-like bracket structure 23 of an adjustable pitch propeller according to FIG. 1. In this case, connecting rod or bracket 23 is formed in two parts 23' and 23". Rod or bracket component 23' contains the cylinder 46 and other rod or bracket component 23" the piston 48 with the piston rod 44 of the cylinder-and-piston unit or mechanism 45. Hydraulic conduits 54 and 55 illustrated in FIG. 9 can be connected in the same manner as shown in FIG. 4.

As mentioned above, the reference or set signal generator 63 generates set or reference value signals for the pitch angle of the individual propeller blades corresponding to the current or momentary angular position of each blade with respect to the hull of the ship. These reference or set values can be determined by experimental measurements and stored in the set or reference value generator, for instance electronically. It will be understood that various reference values or reference value functions for different operating conditions of the ship, for instance, in relation to the loading or to the speed, can be provided in a most simple manner.

While there are shown and described present preferred embodiments of the invention, it is to be distinctly understood that the invention is not limited thereto, but may be otherwise variously embodied and practiced within the scope of the following claims.

Accordingly, what I claim is:

1. An adjustable pitch propeller device for marine vessels, comprising:

a rotatable propeller having a longitudinal axis of drive rotation;

a rotatable propeller shaft for driving said rotatable propeller;

a plurality of propeller blades each rotatably mounted in said rotatable propeller to define a respective axis of pitch rotation extending substantially transverse to said longitudinal axis of drive rotation;

each propeller blade of said plurality of propeller blades defining a respective adjustably predeterminate angle of pitch rotation about said respective axis of pitch rotation in relation to said longitudinal axis of drive rotation;

a pitch adjusting mechanism for substantially simultaneously effecting substantially uniform equal nominal adjustments of said respective adjustably predeterminate angle of pitch rotation of each said propeller blade;

said pitch adjusting mechanism comprising an adjustment motor;

said pitch adjusting mechanism comprising respective connecting means operatively connecting each said propeller blade with said adjustment motor;

each said connecting means comprising a respective pitch correction mechanism for selectively and individually modifying said adjustably predeterminate angle of pitch rotation of each said propeller blade in relation to said substantially uniform equal nominal adjustments thereof;

each said pitch correction mechanism comprising a correction motor;

a respective pitch sensor associated with each said correction motor for generating a momentary pitch position signal corresponding to the momentary value of said adjustably predeterminate angle of pitch rotation of said respective propeller blade;

at least one drive rotation sensor for generating a respective reference signal for each said propeller blade corresponding to a desired reference value of said adjustably predeterminate angle of pitch rotation as a predeterminable function of a momentary value of angular orientation of said rotatable propeller shaft in rotation to the hull of the marine vessel;

a respective control device operatively associated with each said correction motor for cyclically controlling said correction motor to selectively and individually modify said substantially uniform equal adjustments of each said respective adjustably predeterminate angle of pitch rotation during rotation of said rotatable propeller; and each said respective control device comprising means for comparing said momentary pitch position signal with said respective reference signal and means for correspondingly activating each said related correction motor.

2. The adjustable pitch propeller device as defined in claim 1, wherein:

each said propeller blade comprises displaceable journal means arranged eccentrically in relation to said respective axis of pitch rotation;

respective rotatable means operatively associated with each said correction motor and journalled eccentrically in relation to said displaceable journal means;

each said respective connecting means operatively engaging said displaceable journal means and said respective rotatable means; and each said correction motor operatively engaging said respective rotatable means for influencing said respective rotatable means independently of other ones of said propeller blades and said correction motors.

3. The adjustable pitch propeller device as defined in claim 2 wherein:

said eccentrically mounted rotatable means comprise a journal pin and bushing means having an eccentric bore in which there is arranged said journal pin; and said correction motor acting upon said eccentrically mounted rotatable means by rotatably adjusting an angular position of said bushing means.

4. The adjustable pitch propeller device as defined in claim 2, further including:

a shaft at which said journal pin is fixedly mounted;

said journal pin being eccentrically arranged on said shaft; and each said correction motor acting upon each therewith associated eccentrically mounted rotatable means by rotatably adjusting an angular position of said shaft.

5. The adjustable pitch propeller device as defined in claim 2, wherein:

said correction motor comprises a cylinder-and-piston mechanism;

said eccentrically mounted rotatable means being provided with lever means; and said cylinder-and-piston mechanism engaging at said lever means.

6. The adjustable pitch propeller device as defined in claim 2, wherein:

said correction motor comprises a rotary vane motor.

7. The adjustable pitch propeller device as defined in claim 2, wherein:

said pitch adjusting mechanism comprises said adjustment motor which is provided with an adjustment part;

said propeller having a hub defining an axial direction;

said adjustment part being movable in said axial direction; and said eccentrically mounted rotatable means and said correction motor being mounted upon said adjustment part of said adjustment motor.

8. The adjustable pitch propeller device as defined in claim 2, wherein:

said pitch adjusting mechanism comprises said adjustment motor which is provided with an adjustment part;

said adjusting mechanism further comprising a respective connecting rod defined by said respective connecting means and operatively connecting each propeller blade with said adjustment part;

each said connecting rod being provided with first and second bore means;

said rotatable means comprising journal means provided on said adjustment part; and said first bore means of each said connecting rod cooperating with said journal means of said adjustment part and said second bore means cooperating with said propeller blade.

9. The adjustable pitch propeller device as defined in claim 8, wherein:

said journal means provided on said adjustment part is eccentrically mounted on said adjustment part;

said pitch correction mechanism comprising said correction motor defining an actuator for operating said pitch correction mechanism; and said correction motor adjusting the position of said journal means.

10. The adjustable pitch propeller device as defined in claim 8, wherein:

said pitch correction mechanism comprises a cylinder-and-piston mechanism containing a cylinder and a piston equipped with a piston rod reciprocatingly movable within said cylinder;

said connecting rod comprising a two-part structure; and one part of said two-part structure defining said cylinder and the other part of said two-part structure defining mechanism said piston equipped with said piston rod of said cylinder-and-piston.

11. The adjustable pitch propeller device as defined in claim 1 further including:

a respective journal operatively associated with each said propeller blade;

a sliding block cooperating with said journal;

said sliding block being provided with substantially parallel guide surfaces;

guide groove means for guiding said sliding block;

said pitch correction mechanism comprising said correction motor defining an actuator for operating said pitch correction mechanism; and said respective journal being eccentrically mounted in relation to said therewith associated propeller blade and being adjustable by means of said correction motor.

* * * * *

UNITED STATES PATENT AND TRADEMARK OFFICE

CERTIFICATE OF CORRECTION

PATENT NO. : 4,540,341

DATED : September 10, 1985

INVENTOR(S) : WOLFGANG WüHRER

It is certified that error appears in the above—identified patent and that said Letters Patent is hereby corrected as shown below:

Column 8, line 37, please change "rotation" to read --relation--

Column 10, line 30, after "defining" please delete "mechanism"

Column 10, line 31, after "cylinder-and-piston", please insert --mechanism--

Signed and Sealed this

*Twenty-fourth* Day of *December 1985*

[SEAL]

*Attest:*

DONALD J. QUIGG

*Attesting Officer*

*Commissioner of Patents and Trademarks*